US011065774B2

(12) United States Patent
Lowetz

(10) Patent No.: US 11,065,774 B2
(45) Date of Patent: Jul. 20, 2021

(54) SLICING GUIDE APPARATUS

(71) Applicant: Frederick Anthony Lowetz, Weatherford, TX (US)

(72) Inventor: Frederick Anthony Lowetz, Weatherford, TX (US)

( * ) Notice: Subject to any disclaimer, the term of this patent is extended or adjusted under 35 U.S.C. 154(b) by 280 days.

(21) Appl. No.: 15/829,826

(22) Filed: Dec. 1, 2017

(65) Prior Publication Data

US 2018/0085961 A1 Mar. 29, 2018

Related U.S. Application Data

(63) Continuation-in-part of application No. 14/262,776, filed on Apr. 27, 2014, now abandoned.

(60) Provisional application No. 61/934,691, filed on Jan. 31, 2014.

(51) Int. Cl.
*B26B 29/06* (2006.01)
*B26D 3/26* (2006.01)

(52) U.S. Cl.
CPC ..... *B26B 29/063* (2013.01); *B26D 3/26* (2013.01); *Y10T 83/0524* (2015.04)

(58) Field of Classification Search
CPC ..... B26B 29/00; B26B 29/06; B26B 29/063; B26B 29/066
See application file for complete search history.

(56) References Cited

U.S. PATENT DOCUMENTS 920,345 A * 5/1909 Kolodziej ..... A47J 47/005 269/13
1,462,717 A * 7/1923 Maus ..... A23G 9/285 269/13
2,089,980 A * 8/1937 Owen ..... A47J 17/00 83/762
2,108,992 A * 2/1938 Obenshain ..... B26B 29/063 83/762
3,058,503 A * 10/1962 Perakis ..... B26B 29/063 83/764
3,129,000 A 4/1964 Casson
3,315,591 A * 4/1967 Elliott ..... A47J 37/041 99/421 R
3,318,352 A * 5/1967 Seltzer ..... B26B 29/063 269/288
3,452,795 A 7/1969 Davies
(Continued)

FOREIGN PATENT DOCUMENTS

EP 1195123 A 4/2002

*Primary Examiner* — Kenneth E Peterson
*Assistant Examiner* — Richard D Crosby, Jr.
(74) *Attorney, Agent, or Firm* — Aaron P. Peacock; Gagnon, Peacock & Vereeke P.C.

(57) ABSTRACT

A slicing guide apparatus for reducing perishable foods into small, bite-sized pieces, the apparatus having a hollow cylindrical frame defining an open top end, an open bottom end, at least a first set of pair of elongated, vertical slots, at least a second set of pair of elongated, vertical slots that are perpendicular in orientation to the at least first set of pair of elongated, vertical slots, wherein the width of the at least first set of pair of elongated, vertical slots and of the at least second set of pair of elongated, vertical slots permits a cutting utensil to pass therethrough, at least one elongated, vertical rib that protrudes outward from the exterior of the frame and indicia affixed to the frame.

2 Claims, 6 Drawing Sheets

(56) References Cited

U.S. PATENT DOCUMENTS 3,871,079 A * 3/1975 Magee ..... B26B 29/06 30/294
3,987,541 A * 10/1976 Sieczkiewicz ..... A21C 15/04 30/114
4,100,676 A * 7/1978 Ferguson ..... A47G 19/022 30/292
4,125,046 A 11/1978 Kroh et al.
4,580,343 A 4/1986 Bell, Jr.
4,948,106 A * 8/1990 Popeil ..... B26B 29/063 269/295
4,955,271 A 9/1990 Boutin-Lester
4,964,323 A * 10/1990 Fortney ..... B26B 29/063 83/167
4,976,029 A * 12/1990 Kennedy ..... A47J 43/28 30/114
D331,524 S * 12/1992 Buday ..... D7/673
D362,374 S * 9/1995 Roach ..... B26B 29/063 D7/673
D371,728 S * 7/1996 Krueger ..... D32/58
5,598,759 A * 2/1997 Sie ..... B26B 29/063 116/200
D378,979 S * 4/1997 Clubb ..... D7/673
5,653,154 A * 8/1997 Liu ..... B26B 29/063 83/468.5
D383,042 S * 9/1997 Lach ..... A21B 3/135 D7/698
5,662,033 A * 9/1997 Yawman ..... B26D 3/26 83/356.1
5,718,158 A * 2/1998 Rogge ..... A21C 15/04 269/295
5,927,701 A * 7/1999 Chapman ..... B26D 3/30 269/295
6,389,944 B1 * 5/2002 Davidson ..... B26D 3/30 30/114
D611,779 S * 3/2010 Campbell ..... D7/673
7,743,690 B2 * 6/2010 White ..... A41D 13/087 2/16
D699,505 S * 2/2014 Kadva ..... D7/354
8,808,070 B2 * 8/2014 Weng ..... A22C 17/002 452/194
D731,854 S * 6/2015 Weng ..... D7/412
D732,355 S * 6/2015 Diamond ..... D7/673
9,266,247 B1 * 2/2016 Coulon ..... B26B 29/063
D830,795 S * 10/2018 Phillips-Solomon ..... D7/693
10,131,066 B2 * 11/2018 Turover ..... B26B 3/04
10,363,678 B2 * 7/2019 Kloiber ..... B23D 55/082
10,603,762 B2 * 3/2020 Bradford ..... B23D 51/025
2002/0100173 A1 * 8/2002 Suer ..... B26B 3/04 30/114
2003/0037647 A1 * 2/2003 Arterburn ..... D01G 1/04 83/13
2004/0025651 A1 * 2/2004 Bachman ..... A21C 15/04 83/13
2006/0027062 A1 * 2/2006 Whaley ..... B26B 29/06 83/13
2007/0175052 A1 * 8/2007 Schafer ..... B26B 29/06 33/1 B
2009/0019707 A1 * 1/2009 Samuels ..... B26B 15/00 30/289
2012/0045557 A1 * 2/2012 Chapple ..... A21C 11/106 426/383
2012/0160068 A1 * 6/2012 Cahoon ..... B26D 7/0625 83/23
2014/0099418 A1 * 4/2014 Getzinger ..... A47J 47/005 426/520
2015/0134571 A1 * 5/2015 Getzinger ..... A47J 47/005 705/500
2017/0079474 A1 * 3/2017 Stephen ..... A23L 1/0073

* cited by examiner

SLICING GUIDE APPARATUS

CROSS-REFERENCE TO RELATED APPLICATIONS

This Application is a continuation-in-part of application Ser. No. 14/262,776, filed Apr. 27, 2014, which claims benefit of application Ser. No. 61/934,691, filed Jan. 31, 2014, the entire contents of which are incorporated herein by reference.

FIELD OF THE INVENTION

Figure 1:
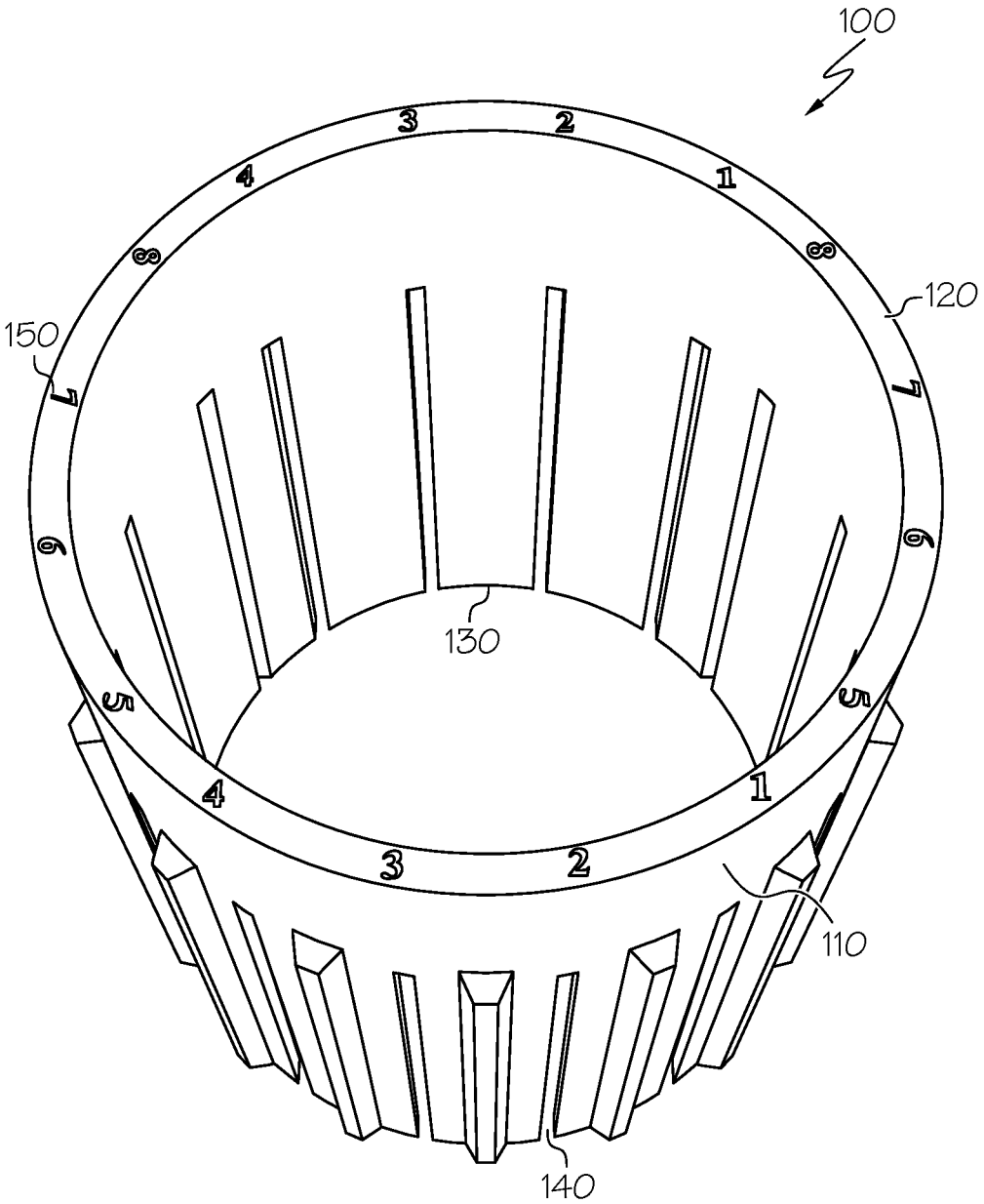
FIG. 1 is a top perspective view of a slicing guide apparatus, an embodiment of the present invention.

The present invention relates to the field of processing foods for consumption, and more particularly, to slicing guides and apparatuses for reducing perishable foods into small, bite-sized pieces.

BACKGROUND

Devices for cutting of food such as lettuce have been developed that comprise a grid of intersecting blades, which, for lettuce, are simultaneously pressed through a half head, or a whole head, of lettuce. While half-head lettuce slicing devices are designed to be affordable to the domestic consumer, they are of very delicate construction and, as such, are not sustainable for long use. Whole-head devices, on the other hand, are designed for high volume commercial use but are unaffordable to the domestic consumer. Both are also difficult to clean, and the multi-blade sets must be disposed and replaced when they become loose or dull. Furthermore, both are expensive. The whole-head devices also require a significant amount of storage space when not in use.

Therefore, a need exists for a novel slicing guide apparatus for domestic use that can reduce perishable food items, such as lettuce, into bite-sized pieces. There is a further need for a lettuce slicing apparatus that is simple to operate, safe, and an affordable alternative to a restaurant-grade lettuce cutting machine, thus requiring very little space to operate and store. There also exists a need for a lettuce slicing apparatus that provides for easy clean-up and comprises a durable design that will last a long time under normal use. Finally, there exists a need for a lettuce slicing apparatus that is able to utilize a low-cost cutting utensil that is replaceable without the need to disassemble or service the apparatus.

It is one object of the present invention to provide a novel slicing guide apparatus that can reduce lettuce, in addition to other perishable and non-perishable food items, into smaller units such as into bite-sized pieces.

Another object of the present invention is to provide a slicing guide apparatus that is simple to operate, safe, and an affordable alternative to both very-delicate domestic half-head and rugged restaurant-grade whole-head lettuce cutting machines, thus requiring very little space to operate and store.

An additional object of the present invention is to provide a slicing guide apparatus that provides for easy clean-up and comprises a durable design that will last a long time under normal use.

A further object of the present invention is to provide a slicing guide apparatus that is able to utilize a low-cost cutting utensil that is replaceable without the need to disassemble or service the apparatus.

The slicing guide apparatus of the present invention can comprise a hollow cylindrical or other shaped frame to receive perishable food items therein such as lettuce as well as other foods. The frame defines an open top end, an open bottom end, at least a first set of pairs of elongated, vertical slots, wherein the at least first set of pairs of vertical slots extend from the bottom end of the cylindrical frame to a position below the top end of the cylindrical frame, at least a second set of pairs of vertical slots that are perpendicular in orientation to the at least first set of pairs of vertical slots, wherein the at least second set of pairs of vertical slots extend from the bottom end of the cylindrical frame to a position below the top end of the cylindrical frame. Furthermore, the frame can comprise at least one elongated, vertical rib that protrudes outward from the exterior of the frame, wherein the at least one elongated, vertical rib extends from the bottom end of the cylindrical frame to a position below the top end of the cylindrical frame. Moreover, the frame defines a rim at the top end thereof. Additionally, the cylindrical frame can comprise indexing of the set of pairs of slots wherein the indexing is affixation of, without limitation, reference characters, numbers, letters, colors and/or other indicia onto the frame, including, without limitation, the rim of the frame, to aid a user when using the present invention.

Generally, when using the invention, a user places the slicing guide apparatus atop a cutting board or other like surface, places lettuce or other food item into the interior of the apparatus and atop the cutting board, inserts the blade of a cutting utensil such as a knife into a pair of slots that is grouped together via the indicia/indexing, passes the blade of the cutting utensil down through the slots and through the food item, removes the blade of the cutting utensil from the slots and the food item and repeats the above processes using another pair of slots that are grouped together via indicia/indexing until the blade has been passed through each pair of slots to completely slice-up the food item.

DETAILED DESCRIPTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New slicing guide apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the Figures or description below.

The present invention will now be described by example and through referencing the appended Figures representing an embodiment of the present invention. FIG. 1 illustrates an example of a slicing guide apparatus 100 ("the apparatus"). In this example, the apparatus 100 comprises a hollow cylindrical-shaped frame 110. The frame 110 defines an opening at the top end 120 of the frame 110 and an opening at the bottom end 130 of the frame 110. Furthermore, the frame 110 defines a plurality of elongated, vertical slot(s) 140, wherein each extend from the bottom end 130 to a portion of the frame 110 that is below the top end 120 and wherein each is associated and used in conjunction with another of the same orientation on the opposite side and form a pair. Additionally, the top end 120 of the frame 110 comprises indicia 150 or the like that constitute a guidance classification for aiding users when operating the apparatus 100. In other embodiments, the frame 110 of the apparatus 100 may be constructed in a plurality of geometric and non-geometric shapes, including, but not limited to, rectangular prism, cube, triangular prism, hexagonal prism, tetrahedron, square pyramid, cone, sphere, or any other three dimensional geometric shapes, including combinations of shapes.

Figure 2:
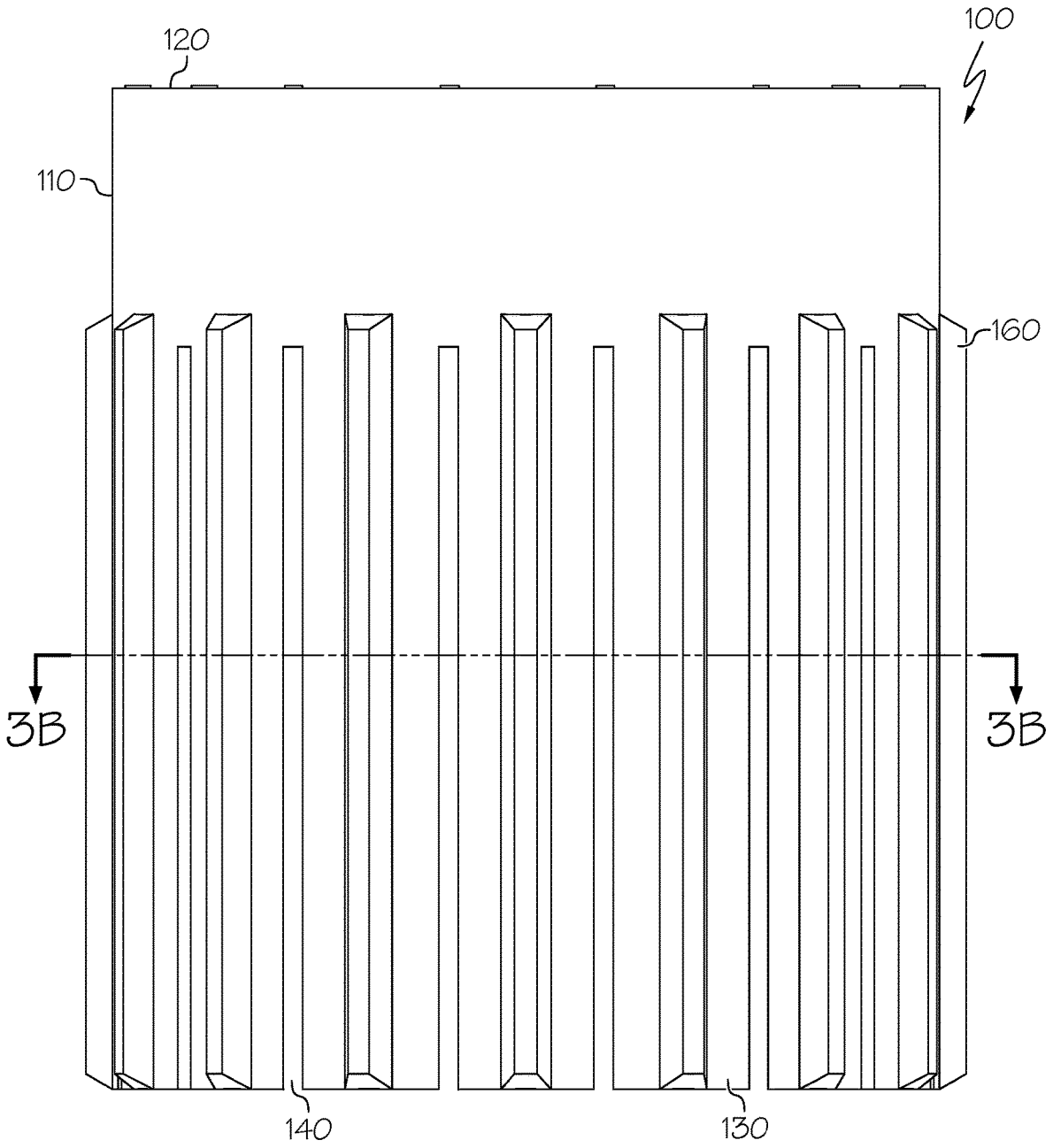
FIG. 2 is a side view of the slicing guide apparatus of FIG. 1.

FIG. 2 illustrates a side view of the apparatus 100. In this view, a portion of the plurality of elongated, vertical slot(s) 140 are shown. The slots 140 are oriented to guide the vertical and horizontal motion of cutting utensils 200 (FIG. 4) that comprise a blade. The slots 140 are also configured to be slightly larger in width than the width of the blade of cutting utensils 200 (FIG. 4) to provide some freedom of movement of a blade of a cutting utensil 200 (FIG. 4) moving in a slot but not so wide as to significantly alter the angle of the blade relative to the item of food within the apparatus 100. Additionally, as shown, the frame 110 comprises a plurality of elongated, vertical rib(s) 160 that strengthen the walls of the frame, each protruding outward from the exterior of the frame 110 and extending from the bottom end 130 to a portion of the frame 110 that is below the top end 120. Each elongated, vertical rib 160 protruding from the frame 110 is positioned adjacent to each defined elongated, vertical slot 140, respectively.

Figure 3A:
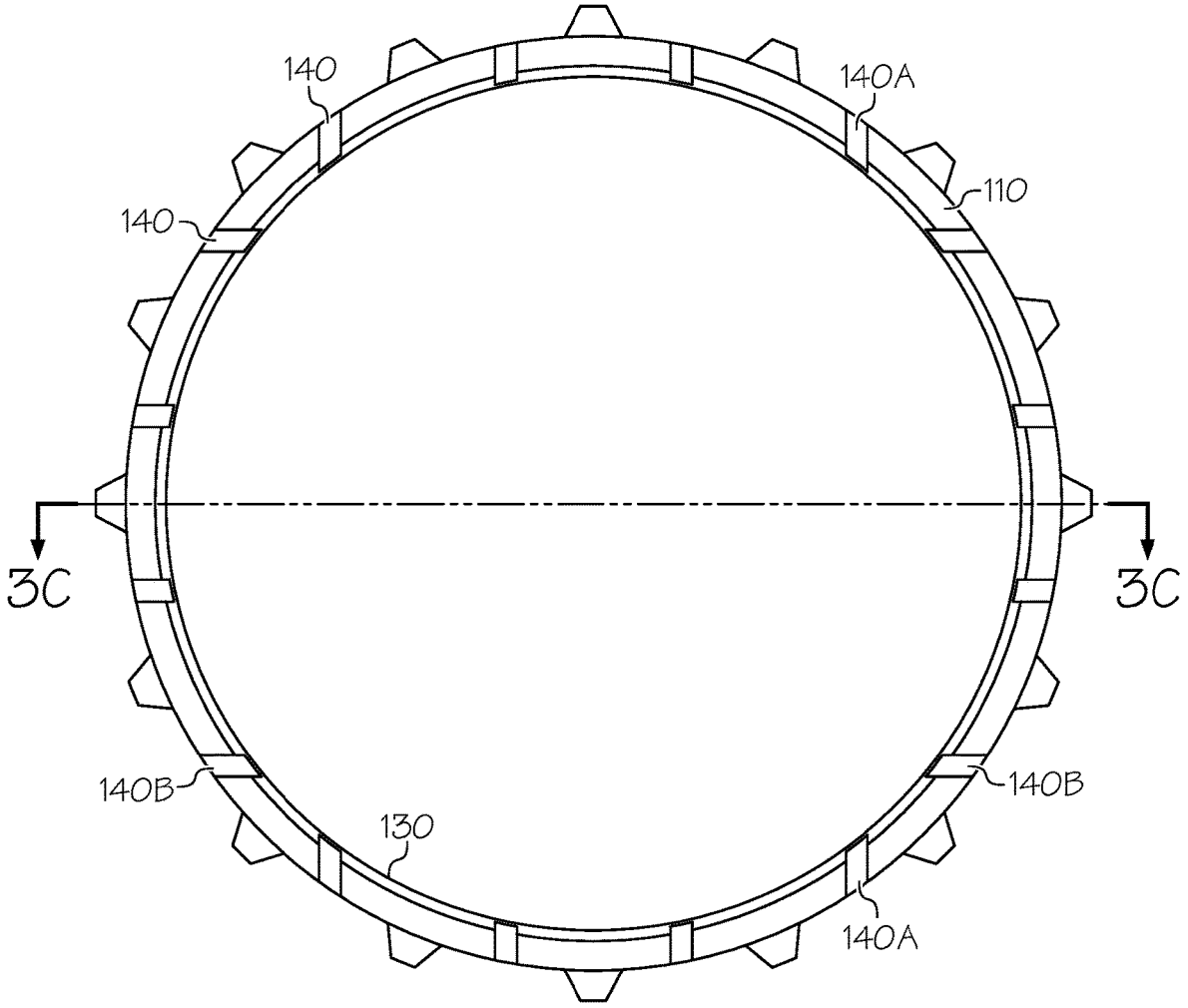
FIG. 3A is the bottom view of the slicing guide apparatus of FIG. 1.
Figure 3B:
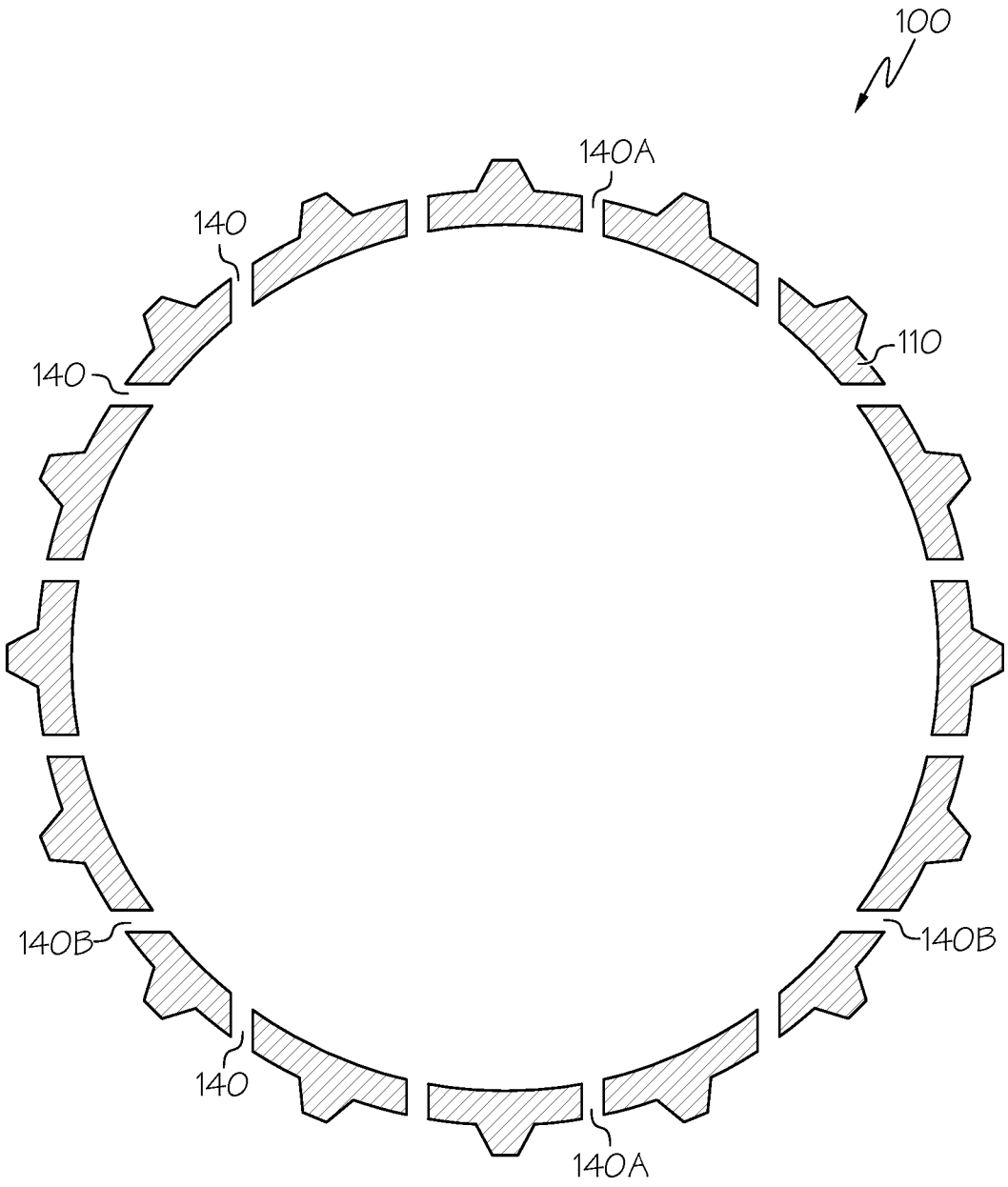
FIG. 3B is the cross-section of the slicing guide apparatus taken along section line 3B-3B in FIG. 2.

Referring now to FIGS. 3A and 3B, the frame 110 defines slots 140A that are arranged in pairs of two such that one is opposite the other around the frame 110 of the apparatus 100. For each pair of slots 140A, the frame 110 defines another pair of slots 140B around the frame 110 of the apparatus 100 that is perpendicular in its orientation. In some embodiments, the frame 110 may define a total amount of sixteen slots 140, resulting in two sets of four pairs of slots in each set. In other embodiments, the frame 110 may define a total amount of twenty slots 140, resulting in two sets of five pairs of slots in each set. In further embodiments, the frame 110 may define a total amount of four slots (i.e., two sets of one pair of slots in each set), thirty-two slots (i.e., two sets of eight pairs of slots in each set), or any suitable number of slot 140 pairs may be used.

FIG. 3A shows the bottom view of an example of a slicing guide apparatus 100. In this illustration, frame 110 is shown defining an opening at the bottom 130 of the apparatus 100 (FIG. 1). In this example, the apparatus 100 comprises two sets of four pairs of slots 140 (sixteen slots total). As shown in this embodiment, the definition of one set of four pairs of slots 140 (labeled as slot pairs 140A) is perpendicular in orientation to the other set of four pairs of slots 140 (labeled as slot pairs 140B). The orientation of the slots of one set of pairs 140A is parallel to each other and also perpendicular to the slots of the other set of parallel slot pairs 140B.

FIG. 3B shows a sectional view from the top of an example of a slicing guide apparatus 100 along the sectional line 3B of FIG. 2. In this example, the apparatus 100 comprises two sets of four pairs of slots 140. As shown in this embodiment, the orientation of one set of four slot pairs 140A is perpendicular to the orientation of the other set of four slot pairs 140B. The orientation of the slots of one set of pairs 140A are parallel to each other and also perpendicular to the orientation of the other set of parallel slot pairs 140B.

The slots 140 may be labeled with indicia. The indicia can be located on the exterior or interior of the frame 110 and/or the top end 120 (FIG. 1), including rim, of the frame 110 (FIG. 1). Some non-limiting examples of indicia may be numeric indicia (1, 2, 3, 4, 5, etc.) or the indicia may be letters (A, B, C, D, E, etc.), or even alphanumeric combinations.

As shown by FIG. 3B, the frame 110 defines each slot 140 to create a cutting channel aligned with an opposite and opposing slot 140 that is also defined to form a slot pair. The angle formed by the definition/orientation of each slot 140 is designed to allow a straight cutting utensil 200 (FIG. 4) to pass through the slot pairs.

Figure 3C:
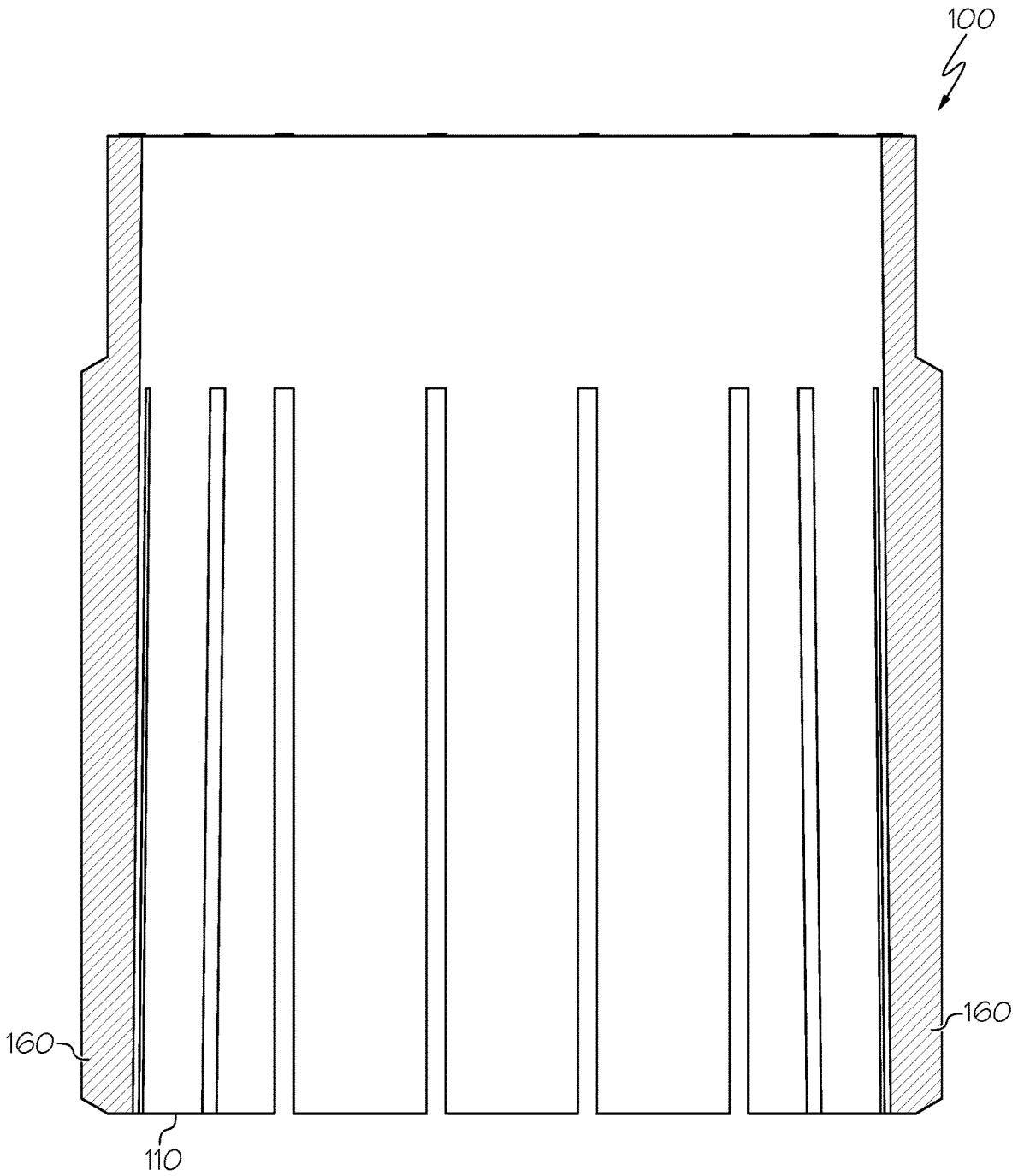
FIG. 3C is the cross-section of the slicing guide apparatus taken along section line 3C-3C in FIG. 3A.

FIG. 3C shows a sectional view from the side of an example of a slicing guide apparatus 100 along the sectional line 3C of FIG. 3A. Vertical ribs 160 are shown protruding from the frame 110.

Figure 4:
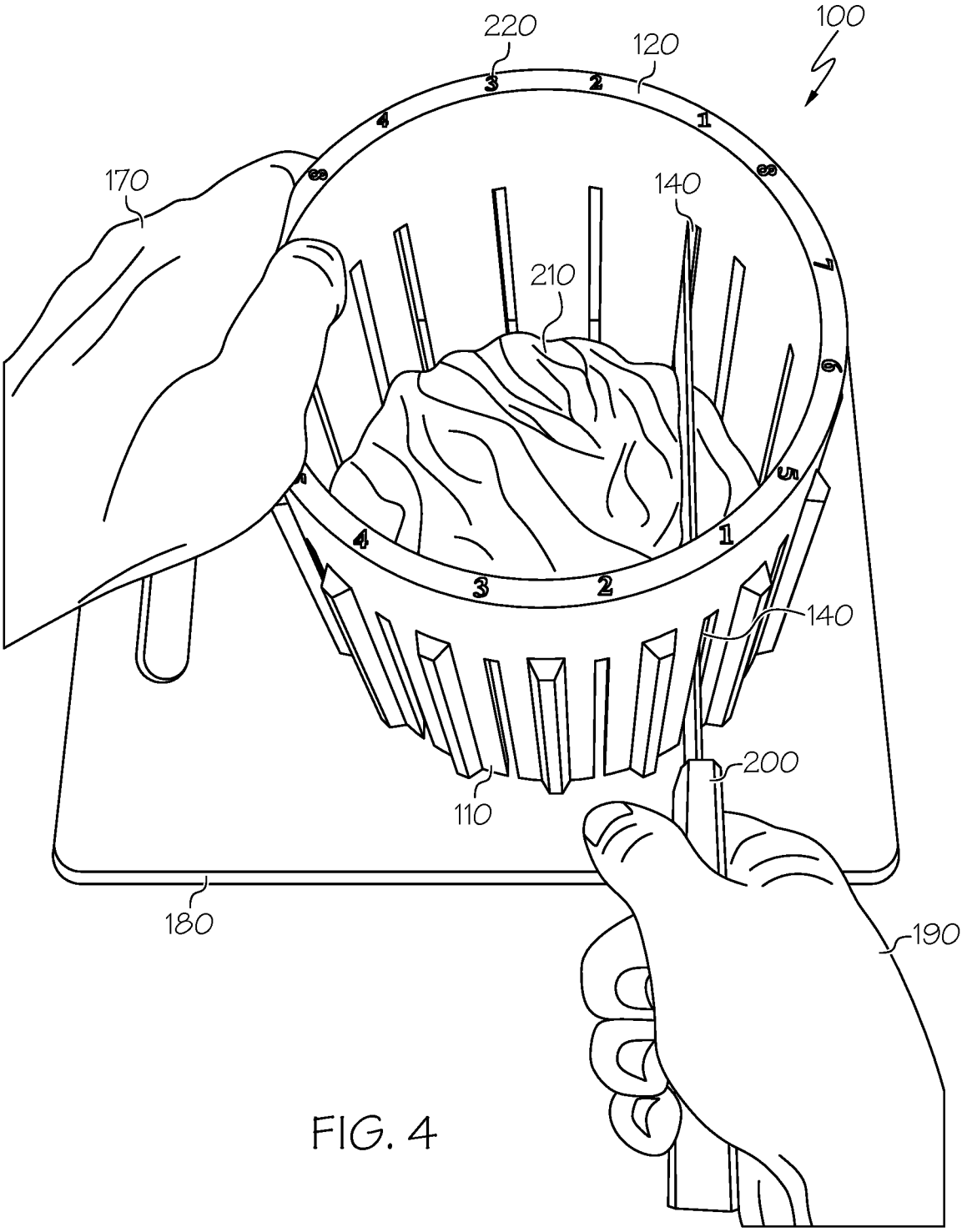
FIG. 4 is a perspective view of the slicing guide apparatus of FIG. 1 in use.

Turning now to FIG. 4, a perspective view of the top end 120 of an example of a slicing guide apparatus 100 is depicted. In this example, a user's left hand 170 is securing the apparatus 100 atop a cutting board 180. The user's right hand 190 is manipulating a cutting utensil 200 to cut a perishable food item 210 such as a head of lettuce. Other types of food or other items may be used with the apparatus 100 as well. In this example, the perishable food item 210 is placed into the interior of the apparatus 100 that is defined by the frame 110. The food item 210 is placed upon a surface such as a cutting board 180 or the like. The blade of the cutting utensil 200 passes through two opposite slots 140 and will slice the perishable food item 210. By placing the blade of the cutting utensil 200 in subsequent pairs of slots 140, the perishable food item 210 is reduced to bite-sized pieces.

The apparatus 100 may be made from durable materials such as hard plastics, metals, metal alloys, wood, hard rubbers, carbon fiber, or any other suitable materials including combinations of materials. Additionally, the apparatus 100 may comprise one or more durable and slightly flexible materials such as soft plastics, silicone, soft rubbers, or any other suitable materials including combinations of materials.

The cutting utensil 200 may comprise metal, metal alloys, a plastic or ceramic cutting blade that is able to easily cut through a perishable food item 210 located within the apparatus 100. In other embodiments, the blade of the cutting utensil 200 may be made from wood, hard rubbers, carbon fiber, or any other suitable materials including combinations of materials.

Also, indicia 220 such as numerals, letters, symbols, or the like may be positioned on the top end 120 of the frame 110 such as the rim and adjacent to one or more slots 140 to facilitate selection of one or more slots 140 through which the user desires to pass the blade of the cutting utensil 200. In other embodiments, the frame 110 may comprise various colors or shapes to facilitate selection of one or more slots 140 through which the user desires to pass the blade of the cutting utensil 200.

One skilled in the art will recognize that while the slicing guide apparatuses described herein are well suited for perishable food items such as lettuce, other types of perishable food items may be used including cauliflower, bread, cabbage, onions, meats, cheese, fruits, tomatoes, pineapples, potatoes, pastas, and any other cooked or uncooked perishable food item that may be cut with the blade of a cutting utensil 200.

Although the present invention has been illustrated and described herein with reference to embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A slicing guide apparatus for reducing perishable foods into small, bite-sized pieces, the apparatus comprising:

a hollow cylindrical frame defining an open top end having a top circular rim, and an open bottom end having a bottom circular rim, wherein the open bottom circular rim permits the frame to set upon a cutting board and thereby provides a surface on which to slice food, a first plurality of pair of elongated, vertical slots that are open to the bottom circular rim and extend to a position below the top end of the frame, a second plurality of pair of elongated, vertical slots that are perpendicular in orientation to the first plurality of pair of elongated, vertical slots and that are open to the bottom circular rim and extend to a position below the top end of the frame, wherein the width of the first plurality of pair of elongated, vertical slots and of the second plurality of pair of elongated, vertical slots permits a cutting utensil to move and pass there through, thereby slicing the perishable food item located within the interior of the frame;

at least one elongated, vertical rib that protrudes outward from the exterior of the frame and that extends from the bottom end of the frame to a position below the top end of the frame; and indicia affixed to the top circular rim, for grouping pairs of slots and providing guidance to a user about the proper knife alignment within the apparatus, the indicia being reference characters, numbers, letters or colors.

2. The slicing guide apparatus of claim 1 wherein the frame is comprised of plastic material.

* * * * *